United States Patent [19]

Fletcher et al.

[11] 4,155,817

[45] May 22, 1979

[54] LOW FREE CYANIDE HIGH PURITY SILVER ELECTROPLATING BATH AND METHOD

[75] Inventors: Augustus Fletcher, Bristol; William L. Moriarty, South Meriden, both of Conn.

[73] Assignee: American Chemical and Refining Company, Inc., Waterbury, Conn.

[21] Appl. No.: 932,859

[22] Filed: Aug. 11, 1978

[51] Int. Cl.[2] ..... C25D 3/46; C25D 3/64

[52] U.S. Cl. ..... 204/43 R; 204/46 R

[58] Field of Search ..... 204/46 R, 43 R, 109, 204/123; 106/1.13, 1.23, 1.26

[56] References Cited

U.S. PATENT DOCUMENTS

| | | | |
|---|---|---|---|
| 2,504,272 | 4/1950 | McCoy | 204/46 R |
| 2,613,179 | 10/1952 | Wolfson et al. | 204/46 R |
| 2,777,810 | 1/1957 | Ostrow | 204/46 R |
| 3,186,926 | 6/1965 | Hofmann et al. | 204/46 R X |
| 3,362,895 | 1/1968 | Foulke | 204/43 R |
| 3,406,107 | 10/1968 | Grebe et al. | 204/46 R |
| 3,507,758 | 4/1970 | Oda et al. | 204/46 R |
| 3,580,821 | 5/1971 | Todt et al. | 204/46 R |
| 3,645,858 | 2/1972 | Dingley et al. | 204/34 |
| 3,679,553 | 7/1972 | Greenspan | 204/43 R |
| 3,984,292 | 10/1976 | Culjkovic | 204/46 R |
| 4,003,806 | 1/1977 | Etter | 204/46 R |
| 4,024,031 | 5/1977 | Lerner | 204/46 R |
| 4,121,982 | 10/1978 | Moriarty et al. | 204/43 R X |

FOREIGN PATENT DOCUMENTS

| | | | |
|---|---|---|---|
| 1228940 | 4/1971 | United Kingdom | 204/43 R |

OTHER PUBLICATIONS

APC 351,241, Weiner, May 18, 1943.

*Primary Examiner*—G. L. Kaplan

[57] ABSTRACT

A bath for electroplating substantially pure silver deposits includes 2–240 grams per liter of alkali metal silver cyanide, a water-soluble electrolyte and a water-soluble selenium compound containing selenium in the -2 oxidation state. The bath has a pH of 8–10 and a free cyanide content of less than 1.5 grams per liter. The bath is maintained at a temperature of 18°–24° Centigrade and may be operated to provide current densities of 0.1–75 amperes per square decimeter.

10 Claims, No Drawings

LOW FREE CYANIDE HIGH PURITY SILVER ELECTROPLATING BATH AND METHOD

BACKGROUND OF THE INVENTION

Silver cyanide plating baths have long been employed and afford significant advantages from the standpoint of commercial plating processes. However, over the years, there have been substantial efforts to develop noncyanide or low cyanide silver plating baths; generally such baths have often been uneconomical to operate or have resulted in dull deposits or have been slow in rate of electrodeposition.

Exemplary of efforts to produce a cyanide-free bath is Culjkovic U.S. Pat. No. 3,984,292 granted Oct. 5, 1976, which utilizes a thiosulfate bath and which uses sulfur or selenium as a brightener. Generally, such baths which are cyanide-free do not function as effectively as baths which complex the silver with cyanide.

In our copending Application Ser. No. 874,893 filed Feb. 3, 1978, now U.S. Pat. No. 4,121,982, we have disclosed a gold/silver alloy plating bath which has little or no free cyanide but which uses alkali metal silver cyanide as the principal source of the silver ion. In our work, we have found certain electrolytes can be combined with the alkali metal silver cyanide to enable us to limit to a very small amount the amount of free cyanide in the bath, thus minimizing some of the problems of toxicity due to fume evolution while at the same time obtaining the commercial advantages of a silver cyanide bath. In our copending application, we disclose the advantages of a selenium brightener in such a low cyanide bath.

It is an object of the present invention to provide a novel, simple bath for electroplating pure silver at varying rates of speed.

It is also an object to provide such a bath which is facile to produce and which may be readily maintained.

Another object is to provide a method for electrodepositing substantially pure silver upon conductive workpieces using such a novel bath and which method is simple, relatively easy to control, and substantially free from cyanide fume evolution.

SUMMARY OF THE INVENTION

It has now been found that the foregoing and related objects may be readily attained in a silver plating bath comprising an aqueous solution of 8–240 grams per liter of a water-soluble electrolyte selected from the group consisting of alkali metal salts of pyrophosphoric acid, phosphoric acid, citric acid, boric acid and tartaric acid, and mixtures thereof; 2–240 grams per liter of alkali metal silver cyanide; and a water-soluble selenium compound containing selenium in the -2 oxidation state and providing 0.1–54.2 parts per million of selenium. The solution has a pH of 8–10 and a free cyanide content of less than 1.5 grams per liter.

The preferred solution utilizes alkali metal pyrophosphate as the electrolyte or at least the principal component thereof, and the pH is most desirably maintained within the range of 8–9. The free cyanide content is preferably maintained in an amount not exceeding 0.75 grams per liter.

For use as a silver strike, the solution preferably contains the alkali metal silver cyanide compound in an amount of 3–4.5 grams per liter, the electrolyte is present in an amount of 80–160 grams per liter, and the selenium compound provides 0.1–0.3 ppm selenium.

This solution desirably is maintained at a pH of 8.5–9.5 and has a specific gravity of 10°–20° Baumé (21° C.).

For the regular electroplating solution, the solution preferably contains the alkali metal silver cyanide compound in an amount of 45–75 grams per liter, the electrolyte is present in an amount of 50–150 grams per liter, and the selenium compound provides 0.4–1.0 ppm selenium. The solution desirably is maintained at a pH of 8–9 and has a specific gravity of 12°–16° Baumé (21° C.).

For a high speed electroplating bath, the solution preferably contains the alkali metal silver cyanide compound in an amount of 90–150 grams per liter, the electrolyte is present in an amount of 50–150 grams per liter, and the selenium compound provides 0.5–1.25 ppm selenium. This solution desirably is maintained at a pH of 8–9 and has a specific gravity of 16°–20° Baumé (21° C.).

In the method of plating the pure silver deposits onto a workpiece having an electrically conductive surface, the workpiece is immersed in the bath while the bath is maintained at a temperature of about 18°–24° Centigrade and an electrical potential is applied across the workpiece and the anode to provide a current density of about 0.1–75 amperes per square decimeter. The potential is applied for a period of time sufficient to effect the desired thickness for the electrodeposit of silver, and thereafter the electroplated workpiece is removed from the bath.

When using the preferred strike solution, the current density is preferably maintained within the range of 0.2–2.0 amperes per square decimeter. When using the regular electroplating bath, current density is preferably maintained within the range of 0.1–20.0 and when using the high speed bath, the current density is preferably maintained within the range of 0.1–50 amperes per square decimeter.

DETAILED DESCRIPTION OF THE PREFERRED EMBODIMENTS

As heretofore discussed, the baths of the present invention essentially comprise the water-soluble electrolyte, the alkali metal silver cyanide and the water-solube selenium compound. Alkali metal hydroxides, or the acids of the electrolytes, may be used to adjust the pH if so desired.

Although any alkali metal silver cyanide may be employed to provide the necessary silver cyanide in the bath, the potassium salt is generally preferred. The amount thereof in the bath will vary depending upon the intended use or speed of operation for the bath, but is generally within the range of 2–240 grams per liter. For example, when the bath is to function as a silver strike solution, the alkali metal silver cyanide is present most desirably within the range of 3–4.5 grams per liter; when it is intended to function as a general purpose bath, the alkali metal silver cyanide is present desirably within the range of 45–75 grams per liter; and when it is desired that the bath function at high speed, the alkali metal silver cyanide is desirably present in the range of 90–150 grams per liter. Lesser amounts of silver will result in rapid depletion of the bath and the necessity for more frequent makeup conditions, whereas greater amounts afford little operating advantage.

The electrolyte is an alkali metal salt of acids selected from the group consisting of pyrophosphoric acid, phosphoric acid, citric acid, boric acid, tartaric acid, and mixtures thereof. The preferred electrolytes are alkali metal pyrophosphates either solely or as the principal portion of the electrolyte. The amount of the electrolyte will vary depending upon the amount of silver in the solution. For example, in a strike solution, the electrolyte is generally present in the amount of 80–160 grams per liter to provide a solution of 10°–20° Baumé. In a regular or medium speed plating bath, the solution will generally contain 50–150 grams per liter of the electrolyte to provide 12°–16° Baumé. In a high speed bath which contains substantially greater amounts of alkali metal silver cyanide, the electrolyte will preferably be within the range of 50–150 grams per liter and now produces 16°–20° Baumé.

Turning now to the selenium compound, this may be any water-soluble selenium compound which produces the selenium ion in the −2 oxidation state. Although various such compounds are known, the alkali metal selenocyanates (NSeCN) are desirable because of their ease of preparation, stability and ease of dissolution. For example, potassium selenocyanate may be prepared by adding potassium cyanide to an aqueous solution containing selenium ion in the −2 oxidation state such as a solution of potassium selenide. However, potassium selenocyanate compounds are commercially available.

The selenium compound is added in an amount sufficient to provide about 0.1–54.2 ppm of selenium ion. Generally, although higher amounts of the selenium ion may be tolerated in the baths of the present invention, amounts in excess of 2.0 ppm provide little additional benefit. Thus, in a strike solution, a desirable selenium ion content is in the range of 0.1–0.3 ppm; in a regular plating bath, it is 0.4–1.0 ppm; and in a high speed bath, it is 0.5–1.25 ppm.

Although the pH of the bath may vary within the range of 8–10, it is preferably maintained within the range of 8–9. The adjustment of pH may be effected by the addition of alkali metal hydroxide or by the addition of the acid whose salt is used to provide the electrolyte.

Temperature control of the bath of the present invention is extremely important since the bath will rapidly deteriorate if the temperature exceeds 24° Centigrade whereas temperatures below 18° Centigrade unduly restrict the plating operation. Thus, in most instances, it will be necessary to effect cooling of the bath because ambient conditions will be in excess of the design operating temperature.

The bath may be used for both rack and barrel plating operations or, in fact, for continuous plating operations at high speed. The deposit of specular brightness can be obtained under all conditions of operation if proper composition and temperature control are maintained. As previously indicated, the bath is operable at current densities of 0.1–75 amperes per square decimeter. Below 0.1 ampere per square decimeter, the plating rate is generally undesirably slow. Agitation is extremely important to obtaining the desirable deposits, particularly in rack plating installations and especially at high speed plating conditions.

Generally, it has been found that other additives produce no additional benefit and in fact tend to interfere with the desirable operation of the bath by inducing foaming or other undesirable characteristics.

In operation of the present baths, anodes which are inert to the bath are employed, such as platinum clad tantalum, columbium or titanium. Other inert anodes may be employed if so desired. The silver ion content in maintained by replacement additions and impurities are removed by continuous or batch filtration of the bath. Conventional agitation equipment may be desirably employed to augment the agitation produced by continuous pumping and filtration of the bath.

Exemplary of specific compositions and conditions are the following:

| Strike Bath | |
|---|---|
| Component | Grams per Liter |
| Potassium Silver Cyanide | 3.8 |
| Tetrapotassium Pyrophosphate | 80 |
| Potassium Selenocyanate | 0.0004 (0.2 ppm Se) |

The pH of the bath is adjusted to 9.0 and exhibits a specific gravity of 10° Baumé at 21° Centigrade. The temperature of the bath is maintained at 21° Centigrade; and the current density for rack plating is desirably 1.0 amperes per square decimeter and for barrel plating, 0.5 amperes per square decimeter, agitation being employed in both instances.

| Regular Speed Bath | |
|---|---|
| Component | Grams per Liter |
| Potassium Silver Cyanide | 60.5 |
| Tetrapotassium Pyrophosphate | 75 |
| Potassium Selenocyanate | 0.00091 (0.5 ppm Se) |

The pH of the bath is adjusted to 8.5 and exhibits a specific gravity of 14° Baumé at 21° Centigrade. The temperature of the bath is maintained at 21° Centigrade; and the current density for rack plating is desirably 10 amperes per square decimeter and for barrel plating, 15 amperes per square decimeter, agitation being employed in both instances.

| High Speed Bath | |
|---|---|
| Component | Grams per Liter |
| Potassium Silver Cyanide | 121 |
| Tetrapotassium Pyrophosphate | 75 |
| Potassium Selenocyanate | 0.0014 (0.75 ppm Se) |

The pH of the bath is adjusted to 8.5 and exhibits a specific gravity of 18° Baumé at 21° Centigrade. The temperature of the bath is maintained at 21° Centigrade; and the current density for rack plating is desirably 20 amperes per square decimeter and for barrel plating, 2.5 amperes per square decimeter, agitation being employed in both instances.

Exemplary of specific test data showing significant factors with respect to operation of baths embodying the present invention are data set forth in the following examples.

EXAMPLE ONE

A solution is prepared containing 80 grams per liter tetrapotassium pyrophosphate, 60.5 grams per liter potassium silver cyanide, with the pH being adjusted to 9.0 using a 10 percent solution of phosphoric acid. This starter composition exhibits a specific gravity of 17.2° Baumé (21° Centigrade). A solution of potassium selenocyanate is separately prepared containing 91.2 ppm selenium. The starter composition is added to a standard Hull cell (267 cc.) and in some instances 3 cc. brightener solution is added to provide 0.5 ppm selenium ion. The test panels are brass having a strike of pure silver.

The anode is platinized tantalum, and mild agitation is provided by a reciprocating paddle moving in front of the brass panel.

| Panel No. | Current Applied, amps. | Time, min. | Temperature | Contains Selenium Ion | Appearance of Electrodeposit |
|---|---|---|---|---|---|
| 1 | 1 | 2 | 21.1° C. | No | Hazy up to 1.2 ASD; bright 1.2–1.5 ASD; cloudy 1.6–4.0 ASD |
| 2 | 2 | 2 | 21.1° C. | No | Cloudy 0–0.8 ASD; bright 0.8–1.2 ASD; dull 1.2–8.0 ASD |
| 3 | 3 | 2 | 21.1° C. | No | Cloudy 0–0.6 ASD; bright 0.6–1.8 ASD; dull 1.8–12.0 ASD |
| 4 | 1 | 2 | 21.1° C. | Yes | Semi-bright 0–0.3 ASD; bright 0.3–0.6 ASD; cloudy 0.6–2.5 ASD; bright 2.5–4.0 ASD |
| 5 | 2 | 2 | 21.1° C. | Yes | Semi-bright 0–2.0 ASD; bright 2.0–7.0 ASD; dull in excess of 7.0 ASD |
| 6 | 3 | 2 | 21.1° C. | Yes | Semi-bright 0–1.8 ASD; bright 1.8–11.0 ASD; dull in excess of 11.0 ASD |
| 7 | 1 | 2 | 48.8° C. | No | Dull 0–8.0 ASD |
| 8 | 2 | 2 | 48.8° C. | No | Dull 0–3.5 ASD; bright 3.5–4.5 ASD; dull 4.5–8.0 ASD |
| 9 | 3 | 2 | 48.8° C. | No | Dull 0–6.0 ASD; semi-bright 6.0–8.0 ASD; dull 8.0–12.0 ASD |
| 10 | 1 | 2 | 48.8° C. | Yes | Dull 0–3.0 ASD; semi-bright 3.0–4.0 ASD |
| 11 | 2 | 2 | 48.8° C. | Yes | Dull 0–6.0 ASD; bright 6.0–10.0 ASD; dull in excess of 10.0 ASD |
| 12 | 3 | 2 | 48.8° C. | Yes | Dull 0–7.5 ASD; bright 7.5–9.0 ASD; dull in excess of 9.0 ASD |

EXAMPLE TWO

A second starter composition is prepared wherein the amount of potassium silver cyanide is 121 grams per liter and the amount of tetrapotassium pyrophosphate is 80 grams per liter. The pH is adjusted to 9.0 using a 10 percent solution of phosphoric acid and the solution exhibits a specific gravity of 18° Baumé (21° C.). The solution of potassium selenocyanate is used as indicated and the other conditions and apparatus are the same as with respect to Example One.

| Panel No. | Current Applied, amps | Time, min. | Temperature | Contains Selenium Ion | Appearance of Electrodeposit |
|---|---|---|---|---|---|
| 1 | 1 | 2 | 21.1° C. | no | Dull 0–.05 ASD; semi-bright .05–.3 ASD; dull .3–1.2 ASD; semi-bright 1.2–2.0 ASD; bright 2.0–3.0 ASD; dull 3.0–4.0 ASD |
| 2 | 2 | 2 | 21.1° C. | no | Semi-bright 0–1.6 ASD; bright 1.6–2.2 ASD; dull 2.2–8.0 ASD |
| 3 | 3 | 2 | 21.1° C. | no | Semi-bright 0–.9 ASD; bright .9–1.8 ASD; dull 1.8–12.0 ASD |
| 4 | 1 | 2 | 21.1° C. | yes | Semi-bright 0–.6 ASD; bright .6–4.0 ASD |
| 5 | 2 | 2 | 21.1° C. | yes | Semi-bright 0–2.0 ASD; bright 2.0–9.0 ASD; dull in excess of 9.0 ASD |
| 6 | 3 | 2 | 21.1° C. | yes | Semi-bright 0–1.8 ASD; bright 1.8–12.0 ASD; dull in excess of 12.0 ASD |
| 7 | 1 | 2 | 48.8° C. | no | Dull 0–4.0 ASD |
| 8 | 2 | 2 | 48.8° C. | no | Dull 0–7.0 ASD; semi-bright 7.0–8.0 ASD; dull in excess of 8.0 ASD |
| 9 | 3 | 2 | 48.8° C. | no | Dull 0–12.0 ASD |
| 10 | 1 | 2 | 48.8° C. | yes | Dull 0–4.0 ASD |
| 11 | 2 | 2 | 48.8° C. | yes | Dull 0–9.0 ASD; bright in excess of 9.0 ASD |
| 12 | 3 | 2 | 48.8° C. | yes | Dull 0–10.0 ASD; bright 10.0–15.0 ASD; dull in excess of 15.0 ASD |
| 13 | 4 | 2 | 48.8° C. | yes | Dull 0–10.0 ASD; bright 10.0–18.0 ASD; dull in excess of 18.0 ASD |

As can be seen from the test data set forth in the preceding examples, the starter solution containing the potassium selenocyanate will produce a desirable range of specular brightness at a plating temperature of about 21° Centigrade. Increasing the temperature to above about 24° Centigrade has been found to rapidly destroy the brightness of the electrodeposit obtained, and reducing the temperature below 18° Centigrade significantly affects the rate of deposition and the economy. In practice, it has been found that the free cyanide content will stabilize at 0.75 grams per liter or less with some evolution of cyanide fumes occurring during operation so that suitable exhaust systems should be employed.

From the foregoing detailed specification and examples, it can be seen that the novel bath of the present invention is one which accords the advantages of a cyanide silver bath while at the same time minimizes the toxicity resulting from the use of cyanide components. The bath composition may be readily controlled to minimize the amount of free cyanide, and evolution of cyanide gas is substantially reduced. Specular brightness is obtained over a fairly broad range of current density within a controlled temperature range.

Having thus described the invention, we claim:

1. A silver plating bath comprising an aqueous solution of:

A. 8–240 grams per liter of a water-soluble electrolyte selected from the group consisting of alkali metal salts of pyrophosphoric acid, phosphoric acid, citric acid, boric acid and tartaric acid, and mixtures thereof;

B. 2–240 grams per liter of alkali metal silver cyanide; and

C. a water-soluble selenium compound containing selenium in the −2 oxidation state and providing 0.1–54.2 parts per million of selenium;

said solution having a pH of 8–10 and a free cyanide content of less than 1.5 grams per liter.

2. The silver plating bath in accordance with claim 1 wherein said water-soluble electrolyte is alkali metal pyrophosphate.

3. The silver plating bath in accordance with claim 1 wherein said solution has a pH of 8–9 and the free cyanide content is not more than about 0.75 grams per liter.

4. The silver plating bath in accordance with claim 1 wherein said alkali metal silver cyanide compound is present in an amount of 3–4.5 grams per liter, wherein said electrolyte is present in an amount of 80–160 grams per liter, wherein said water-soluble selenium compound provides 0.1–0.3 ppm of selenium, wherein said solution has a pH of 8.5–9.5 and a specific gravity Baumé of 10°–20° (21° C.).

5. The silver plating bath in accordance with claim 1 wherein said alkali metal silver cyanide compound is present in an amount of 45–75 grams per liter, wherein said electrolyte is present in an amount of 50–150 grams per liter, wherein said water-soluble selenium compound provides 0.4–1.0 ppm of selenium, wherein said solution has a pH of 8–9 and a specific gravity Baumé of 12°–16° (21° C.).

6. The silver plating bath in accordance with claim 1 wherein said alkali metal silver cyanide compound is present in an amount of 90–150 grams per liter, wherein said electrolyte is present in an amount of 50–150 grams per liter, wherein said water-soluble selenium compound provides 0.5–1.25 ppm of selenium, wherein said solution has a pH of 8–9 and a specific gravity Baumé of 16°–20° (21° C.).

7. In a method of electroplating substantially pure silver deposits upon a workpiece, the steps comprising:

A. immersing a workpiece having an electrically conductive surface in a silver plating bath comprising an aqueous solution of:

1. 8–240 grams per liter of a water-soluble electrolyte selected from the group consisting of alkali metal salts of pyrophosphoric acid, phosphoric acid, citric acid, boric acid and tartaric acid, and mixtures thereof;

2. 2–240 grams per liter of alkali metal silver cyanide; and 3. a water-soluble selenium compound containing selenium in the −2 oxidation state and providing 0.1–54.2 parts per million of selenium;

said solution having a pH of 8–10 and a free cyanide content of less than 1.5 grams per liter;

B. maintaining the temperature of said bath at about 18°–24° Centigrade;

C. applying an electrical potential across said workpiece and an anode to provide a current density of about 0.1–75 amperes per square decimeter at said workpiece for a sufficient time to effect the desired thickness for the electrodeposit; and D. removing the electroplated workpiece from said bath.

8. The method in accordance with claim 7 wherein said alkali metal silver cyanide compound is present in an amount of 3–4.5 grams per liter, wherein said electrolyte is present in an amount of 80–160 grams per liter, wherein said water-soluble selenium compound provides 0.1–0.3 ppm of selenium; wherein said solution has a pH of 8.5–9.5 and a specific gravity Baumé of 10°–20° (21° C.), and wherein said current density is 0.2–2.0 amperes per square decimeter.

9. The method in accordance with claim 7 wherein said alkali metal silver cyanide compound is present in an amount of 45–75 grams per liter, wherein said electrolyte is present in an amount of 50–150 grams per liter, wherein said water-soluble selenium compound provides 0.4–1.0 ppm of selenium, wherein said solution has a pH of 8–9 and a specific gravity Baumé of 12°–16° (21° C.), and wherein said current density is 0.1–30.0 amperes per square decimeter.

10. The method in accordance with claim 7 wherein said alkali metal silver cyanide compound is present in an amount of 90–150 grams per liter, wherein said electrolyte is present in an amount of 50–150 grams per liter, wherein said water-soluble selenium compound provides 0.5–1.25 ppm of selenium, wherein said solution has a pH of 8–9 and a specific gravity Baumé of 16°–20° (21° C.), and wherein said current density is 0.1–50.0 amperes per square decimeter.

* * * * *